US006488270B2

(12) United States Patent
Whiteis

(10) Patent No.: US 6,488,270 B2
(45) Date of Patent: Dec. 3, 2002

(54) APPARATUS FOR CREATING VORTEX RINGS IN A FLUID MEDIUM

(76) Inventor: David E. Whiteis, 18429 Stone Hollow Dr., Germantown, MD (US) 20874

( * ) Notice: Subject to any disclaimer, the term of this patent is extended or adjusted under 35 U.S.C. 154(b) by 10 days.

(21) Appl. No.: 09/739,145

(22) Filed: Dec. 18, 2000

(65) Prior Publication Data

US 2002/0074673 A1 Jun. 20, 2002

(51) Int. Cl.[7] ..... B01F 3/04

(52) U.S. Cl. ..... 261/62; 261/64.1; 261/81; 261/121.1

(58) Field of Search ..... 261/62, 64.3, 64.5, 261/65, 64.1, 81, 121.1, 123

(56) References Cited

U.S. PATENT DOCUMENTS

| | | | | | |
|---|---|---|---|---|---|
| 2,855,714 | A | | 10/1958 | Thomas | |
| 3,414,248 | A | * | 12/1968 | Iwanaga et al. | 261/123 |
| 3,589,603 | A | | 6/1971 | Fohl | 239/11 |
| 3,664,647 | A | * | 5/1972 | Snow et al. | 261/81 |
| 3,788,616 | A | * | 1/1974 | Clough, Jr. | 261/81 |
| 3,804,328 | A | | 4/1974 | Lane et al. | 239/2.1 |
| 4,088,716 | A | * | 5/1978 | Stoev et al. | 261/81 |
| 4,495,114 | A | * | 1/1985 | Strauss | 261/81 |
| 4,534,814 | A | | 8/1985 | Takahashi et al. | 261/64.3 |
| 4,688,519 | A | * | 8/1987 | Fischer | 261/81 |
| 4,844,844 | A | * | 7/1989 | Michelson | 261/62 |
| 5,052,813 | A | | 10/1991 | Latto | 366/348 |
| 5,054,422 | A | * | 10/1991 | Nojima et al. | 261/123 |
| 5,100,242 | A | | 3/1992 | Latto | 366/267 |
| 5,416,994 | A | | 5/1995 | McLaughlin | 40/406 |
| 5,947,784 | A | | 9/1999 | Cullen | 446/15 |
| 6,007,237 | A | | 12/1999 | Latto | 366/315 |
| 6,029,955 | A | * | 2/2000 | Drie | 261/81 |
| 6,293,529 | B1 | * | 9/2001 | Chang et al. | 261/123 |
| 6,322,056 | B1 | * | 11/2001 | Drie | 261/81 |

* cited by examiner

*Primary Examiner*—C. Scott Bushey
(74) *Attorney, Agent, or Firm*—Lieberman & Brandsdorfer, LLC

(57) ABSTRACT

The invention is a method and apparatus for generating vortex rings in a fluid medium. The apparatus is immersed in a body of water, and an air pump feeds gas in the form of air directly into the base of the apparatus through a gas inlet or the gas is provided from a container with a Finite quantity of gas. A nozzle extends from the gas inlet to a pocket located on an underside of a lever. As air is pumped into the pocket, the air forms a single bubble, and when the force of the air mass exceeds the weight of the lever, the lever rises and the air mass travels as a cohesive unit to an exit nozzle. When the lever reaches the maximum height displacement defined by a resilient upper stop, the air exits the lever through a nozzle and forms a vortex ring.

20 Claims, 5 Drawing Sheets

APPARATUS FOR CREATING VORTEX RINGS IN A FLUID MEDIUM

BACKGROUND OF THE INVENTION

1. Technical Field

This invention relates to a method and apparatus for producing vortex rings of gas in a fluid medium. More specifically, the apparatus may operate automatically with a finite supply of a gas, or it may be connected to a supply of gas such that the vortex rings are generated automatically and continuously.

2. Description of the Prior Art

Vortex rings are aesthetically pleasing artifacts with behaviors and aspects that are very interesting to many people. A smoke ring, which is a form of a vortex ring made from a visible form of gas, can be made to traverse a small room, and even extinguish a candle flame several feet away from where the smoke ring was generated. However, vortex rings are not limited to smoke rings. A vortex ring of identical size to a smoke ring may be made of air instead of smoke. Such a ring comprises similar characteristics to a smoke ring, and can also travel invisibly across the same room and extinguish a candle flame. Vortex rings have been studied by students in the field of fluid dynamics, which is an important part of airplane design and other engineering disciplines.

Most people have only seen a vortex ring in the form of a smoke ring. However, there is another form of a vortex ring that can be studied and enjoyed without involving the many known severe dangers and drawbacks associated with the creation of smoke rings through the use of tobacco. This alternative form of a vortex ring is a ring made of a gas and travels vertically upward through a liquid medium. When created out of air within a medium of water, these vortex rings have also been known as bubble rings. They are enjoyable to play with and to study, although they have not been easy for the average person to generate.

Dolphins have also been known to generate bubble ring type vortex rings, possibly for the entertainment and enjoyment of the exercise. However, these vortex rings are not readily available for viewing by humans, of course, since dolphins live and swim in the depths of the Earth's oceans, and have been captured on film creating bubble rings only a very few times. In addition, there is another place where vortex rings are thought to form which is of interest to people, and that is in the inside of some human's hearts. If the studies are correct, the vortex rings are made of blood, and travel through the blood in the heart chamber, in patients with certain heart problems. Accordingly, there are several reasons why it is desirable to have a way to create vortex rings in a form that can be easily observed, studied, learned from and enjoyed.

There are several recent U.S. Patents which disclose different mechanical apparatus to aid in the production of vortex rings. In general, each of these patents relate to the generation of vortex rings in a fluid environment, such as water, with the use of air as the gas. For example, U.S. Pat. No. 5,947,784 to Cullen teaches an apparatus for use by a human being in a fluid immersed environment. The apparatus comprises an elbow shaped tool with an elongated horizontal portion, and an elbow leading to a short vertical portion. At the end of the vertical portion, the apparatus includes a valve assembly. The elongated portion of the apparatus allows air to exit the apparatus away from the user's face and hands, so that the air and water near the short vertical portion is not exposed to any turbulence. The configuration of the valve body that closes when the user stops blowing air through the elongated portion causes the bubble of air that is released to be one large bubble of air, and helps produce the toroidal configuration of the vortex rings. In general, the valve assembly responds to short bursts of air through an elongated passageway to produce vortex rings. Alternatively, the elongated section of the apparatus may be connected to a source of gas under pressure. The introduction of a burst of gas under pressure causes the body of the valve to momentarily be unseated thereby allowing a burst of gas to escape and produce the toroidal shaped vortex ring. Accordingly, the Cullen patent requires a person to be immersed under water or for a gas under pressure to deliver short bursts of air to momentarily unseat the valve and to produce a vortex ring.

U.S. Pat. No. 4,534,914 to Takahashi et al. teaches an apparatus for producing vortex rings. The apparatus uses an accumulator in the form of a cylindrical cup, wherein gas enters the accumulator and exits through an outlet affixed with a nozzle. When the accumulator is in a non-operating position, the valve member is urged by a coil spring toward the gas outlet, causing a seal of the outlet. However, in order to produce the vortex rings, a gas under pressure is introduced to the accumulator thereby causing an increase in the pressure in the interior chamber of the accumulator. The pressure of the gas causes the diaphragm to be outwardly inflated against surrounding water pressure and the force of the spring, which altogether takes the valve member out of contact with the gas outlet and discharges a pocket of gas through an exit nozzle. The gas stored in the accumulator is discharged into the nozzle which is closed by water pressure so that the nozzle is instantaneously opened. Accordingly, the Takahashi et al. patent require gas under pressure to be supplied to a chamber, and based upon the pressure of the gas the valve is unseated resulting in the generation of a vortex ring.

Accordingly, what is desired is an apparatus for generating vortex rings which eliminates the need for supplying gas under pressure, and eliminates the necessity for manual operation. It is not desirable to have a human being supply short burst of air to a nozzle apparatus submerged in a fluid environment. The person submerged in the fluid will have to hold their breath and as such will not be able to provide short bursts of air to the apparatus for an extended period of time. In addition, the human error factor is significantly increased when a person is submerged under water without an independent supply of oxygen. Accordingly, it is desirable to provide a simple mechanical apparatus which can automatically generate vortex rings using a supply of pressurized or unpressurized gas.

SUMMARY OF THE INVENTION

It is therefore an object of the present invention to provide an apparatus for immersing in a fluid environment for generating vortex rings through the supply of a gas with or without pressure.

It is another object of the present invention to provide a method of generating a continuous supply of vortex rings through a supply of gas entering the apparatus.

It is an even further object of the invention to provide an apparatus that comprises a gas inlet that may be modified for accepting gas from a finite source or from an infinite source of air. The inlet directs the gas to a pocket on an underside of a lever. When the upward buoyancy of the gas in the pocket exceeds the downward weight of the lever, the lever moves upwards slightly, changing the tilt angle of the lever and allowing the gas within the pocket to exit the underside of the lever through a nozzle. Based upon the design of the nozzle and the state of the gas, a vortex ring is created.

It is a further object of the invention to provide an apparatus for immersion into a fluid environment and generating vortex rings from a finite supply of gas. The apparatus comprises a spring mechanism which remains closed in a rest position. A lever may be activated to supply a burst of air through an exit nozzle to produce a vortex ring.

These and other objects of the invention are produced through an apparatus and method for forming a vortex ring of gas in a fluid medium. The apparatus comprises a lever with a pocket formed within the underside of the lever at a proximal end, a hinge-type attachment at the proximal end of the lever which permits the lever to vertically pivot a limited distance, an inlet for introducing a gas to the underside of the lever, and a nozzle located at a distal end of the lever extending from an underside surface to a top surface. In addition, the apparatus comprises two adjustable stops, a lower stop for controlling downward displacement of the lever when it is in the lower position, and an upper stop for controlling upward displacement of the lever when the buoyancy of the gas lifts the lever. As gas is introduced to the underside of the lever by way of the inlet, the gas fills the pocket region on the underside of the lever. During the accumulation of the gas within the pocket, the buoyancy of the gas will become greater than the weight of the lever in the fluid. When the lift generated by the gas within the pocket region of the underside of the lever exceeds the downward pressure of the lever, the lever will rise tilting slightly upward and cause the gas to travel along an underside surface of the lever toward the nozzle. The shape and design of the underside of the lever, including a smooth gradual transition from the flat underside of the lever to the entrance of the nozzle, causes the gas to remain in a unitary bubble and allows the gas to exit the nozzle in a short burst generating a vortex ring. Accordingly, once the air under the lever has been released and the weight of the lever exceeds that of the gas within the pocket or there is no gas present in the pocket, the lever will return to the starting position adjacent to the lower stop once again prepared to begin the cycle of accepting air into the pocket region.

Other features and advantages of this invention will become apparent from the following detailed description of the presently preferred embodiment of the invention, taken in conjunction with the accompanying drawings.

DESCRIPTION OF THE PREFERRED EMBODIMENT

Technical Background

Figure 1:
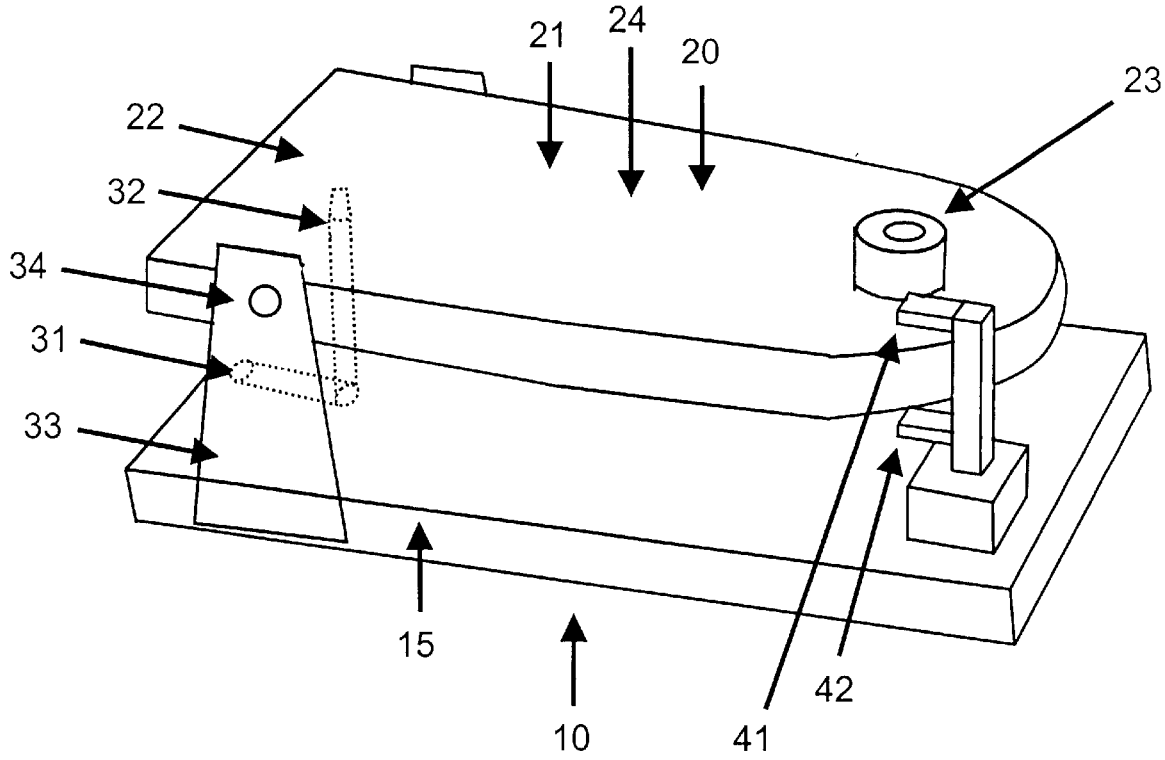
FIG. 1 is a perspective view of an apparatus for producing vortex rings according to the preferred embodiment of the invention, and is suggested for printing on the first page of the issued patent.

A vortex ring is a cohesive ring of fluid or gas that is created in a fluid or gas medium and travels in a particular direction through that medium. The most well known forms of vortex rings are made of smoke generated by the burning of tobacco products. However, another common form of vortex rings are bubble rings that are created in water. A bubble ring is created by releasing a pulse of air into water that is relatively free of turbulence. There are other specific parameters which must be adhered to in order to produce a gas vortex ring within a body of water.

In general, the pulse of air must be released into the water through an opening that points in an upward direction towards the surface of the water. The opening may simply be an aperture within a flat surface that is horizontal with respect to the surface of the water, or it may be a nozzle. However, the opening should be round or comprise a similar shape. The pulse of air that is released through the aperture should originate from a relatively turbulence-free reservoir of air. Any turbulence that does exist within the supply of air as it is released through the aperture should be symmetrical to an axis traveling through the center of the aperture, and any turbulence added to the air by a valve that may be used to control the flow of air out of the apparatus should also be symmetrical to an axis traveling through the center of the aperture. Accordingly, the state of the air prior to exiting the nozzle is but one important factor.

The air that is released from the aperture should be in the form of a pulse that begins and ends suddenly. Furthermore, the air should be in the form of a unitary bubble prior to release, and not in the form of a trail or plurality of bubbles. In addition, the pocket of air prior to release through the aperture should be approximately five to twenty times the volume of an imaginary sphere, wherein the diameter of that sphere is the same diameter as the aperture through which the air is to be released. Alternative proportions of the size of the pocket of air in relation to the diameter of the aperture may be employed for generating vortex rings in a fluid environment.

The bubble ring will form within one second after being released from the aperture. Like any stable vortex ring traveling through a liquid or gaseous medium, the volume of the air or gas in the ring rotates as it travels through the fluid medium. Gas adjacent to the outer edge of the ring moves in an upward direction at a slower pace than the ring's overall upward movement, and the gas adjacent to the inside of the ring moves upward faster than the ring's overall vertical movement. Accordingly, if an observer ignores the ring's overall upward movement through the water, a speck of dust that was in the air of the ring near the surface of the ring would appear to spin, appearing first adjacent to the external edge of the ring, then adjacent to the bottom of the ring, then adjacent to the inside edge of the ring, and then adjacent to the top of the ring, repeating the pattern accordingly.

A bubble ring's spin is caused by the ring's vertical movement through the water, and by the fact that the outside edge of the ring has a greater surface area than the inside edge, and is therefore affected by the friction created as a gas moves through the water. The spin makes the ring a stable object that enables the bubble to maintain its shape while traveling vertically in the water. As the ring travels toward the surface of the water, the diameter of the ring gradually increases. In general a bubble ring will maintain its shape until it hits the surface of the water, or until the diameter of the ring grows too large, at which time is becomes unstable and breaks up into ordinary bubbles. Accordingly, the characteristics of the water and air prior to release through a round or near round opening are critical characteristics for forming a vortex ring in a fluid medium.

Technical Details

Figure 2:
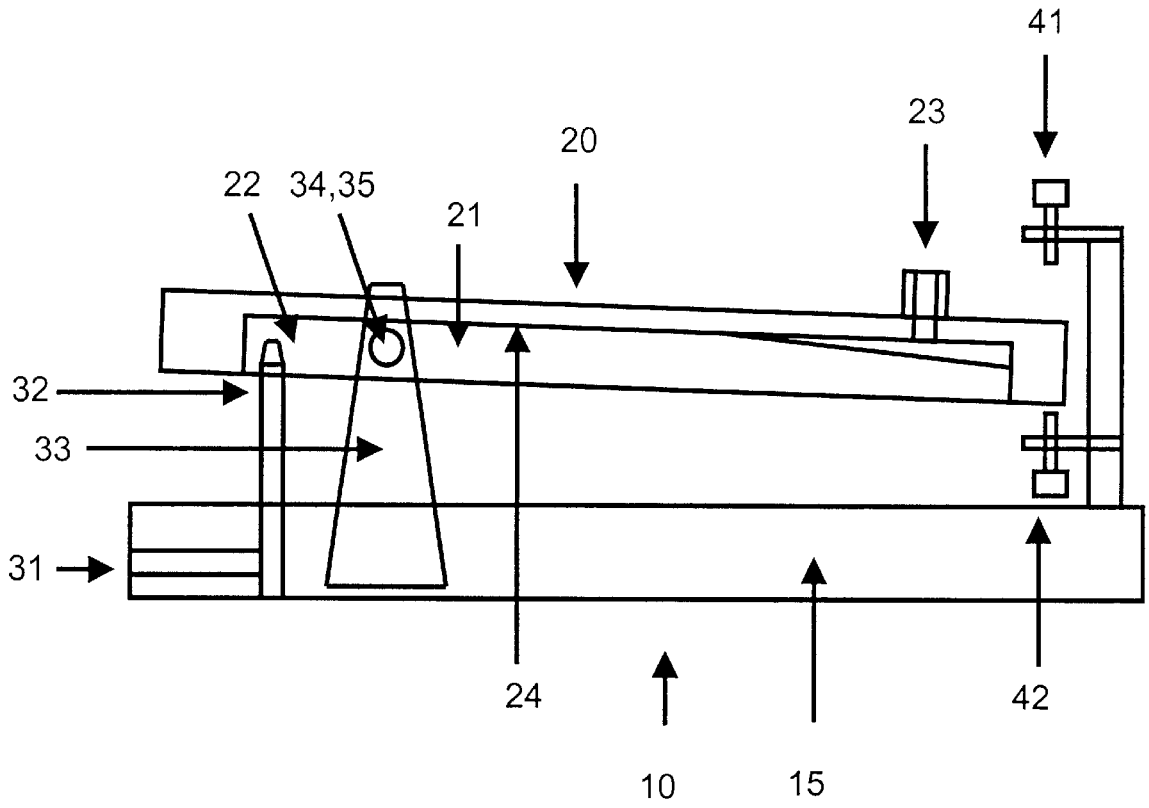
FIG. 2 is a side elevational view of the apparatus of FIG. 1 taken from the right side.

FIGS. 1 and 2 are illustrations of an apparatus for producing vortex rings in a fluid environment. Optimally, the apparatus is completely submerged in a tank and/or pool of water. The reference numeral 10 designates the apparatus. In a preferred embodiment, the apparatus is comprised of a plastic material to provide the smooth edges and proper integrity to produce the vortex rings. However, alternative materials may be used that have the proper density and characteristics to produce the vortex rings. The apparatus comprises a base 15 with a weight of sufficient matter so as to enable the apparatus 10 to rest on a bottom surface of a tank and/or pool. The apparatus 10 comprises a lever 20, a lower adjustable stop 42, an upper adjustable stop 41, a gas inlet 31, and an inlet nozzle 32. The lever is mounted above the base 15 by a pair of hinges 34 and 35. A bottom surface 24 of the lever 20 has a pocket 21 extending from an area adjacent to a gas inlet toward the exit nozzle 23. The pocket is designed to accommodate the gas and to move the gas toward the exit nozzle 23. As the pocket 21 becomes filled with a gaseous fluid from the inlet nozzle 32, the buoyancy of the gas pocket increases. At such time as the upward pressure of the gas becomes greater than the weight of the lever 20, the lever begins to rise, and the gas travels along the lower surface 24 toward the exit nozzle 23.

The pocket extends from the proximal part of the underside of the lever 22 to the nozzle. The pocket is almost as wide and as deep as the lever itself at the proximal end of the lever. However, as the pocket gets closer to the outlet nozzle at the distal end of the lever, the pocket gets more narrow because it is more shallow at the edges. This encourages the gas to flow directly out the exit nozzle. In addition, the smooth underside of the pocket allows the gas to flow without any impediments, and with a minimum of turbulence added to the gas. Accordingly, the pocket extends from the gas inlet 32 to the nozzle 23, with a gradually narrowing width of the pocket thereby forcing the gas to flow along the length of the pocket to the exit nozzle 23.

The upper adjustable stop 41 and lower adjustable stop 42 function together to define the vertical calibrating and height parameters of the lever 20. The lower adjustable stop 42 defines the rest position of the lever 20 prior to the entry of any gas through the gas inlet. The upper adjustable stop 41 defines the maximum height to which the lever may rise, caused by the entry of gas through the gas inlet. Both the upper and lower adjustable stops must be properly calibrated in order for the apparatus 10 to produce a maximum quantity and quality of vortex rings. In addition, the calibration of the adjustable stops 41 and 42 are determinative of the size of the vortex rings. The calibration of the adjustable stops define the quantity of gas that may enter and fill the pocket 21. Accordingly, the correct adjustment and calibration of the upper and lower adjustable stops 41 and 42, respectively, in accordance with the external gas source is critical to the proper functioning of the apparatus.

In a preferred embodiment, the upper stop is resilient for enhancing the quality and consistency of the bubble ring. The resilience of the upper stop 41 affects the manner in which the lever 20 hits the upper stop 41. The resilience of the upper stop 41 contributes to the rebounding effect of the stop 41 against the lever 20 at such time as the lever rises to the maximum displacement available. The rebounding effect of the lever 20 against the stop 41 creates a sudden end to the pulse of gas exiting the nozzle 23, thereby directly effecting the quality of the resulting vortex ring. Accordingly, the resilience of the upper stop 41 contributes to the repeated creation of vortex rings from a unitary gas bubble formed within a pocket of the lever.

The apparatus comprises a gas inlet 31 which is adapted to accept gas from a finite or infinite source. The gas inlet extends from the base to an area just below the pocket and is accommodated with a longitudinal nozzle 32. The longitudinal nozzle 32 is mounted to an exit aperture of the gas inlet 31, so as to extend from the gas inlet to the underside of the lever 20. The nozzle 32 actually extends from the gas inlet 31 directly to the pocket 21 at 22, thereby supplying a gas to the pocket directly from the external gas source. The inlet nozzle 32 essentially inflates the underside of the lever 20 with a gas to formulate a single bubble in the pocket. As more gas is introduced to the pocket 21, the bubble 22 grows. The supply of gas to the pocket produces a single unitary bubble. It is critical that the longitudinal nozzle 32 enter the pocket of gas 22. This allows the gas to form a unitary pocket as opposed to a plurality of bubbles within a pocket. As the longitudinal nozzle 32 supplies gas to the pocket 22, the quantity of gas increases and the pressure of the gas in combination with the design of the pocket, and the unitary bubble of gas moves toward other regions of the pocket. Accordingly, the gas inlet 32 in combination with the longitudinal nozzle are designed to provide a source of gas directly to the underside of the lever 24 and into the pocket 22.

Figure 3:
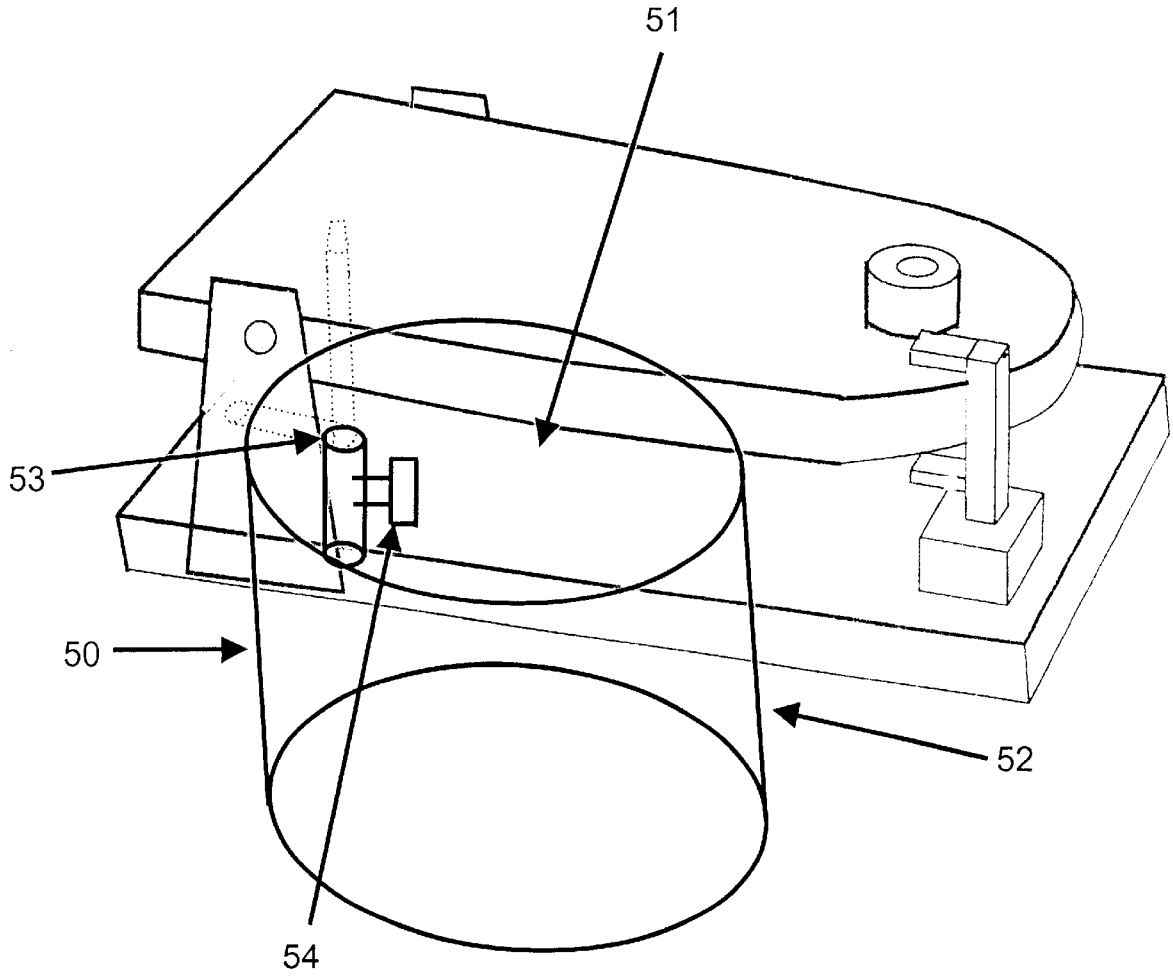
FIG. 3 is a perspective view of an alternative embodiment of FIG. 1.

In an alternative embodiment, the apparatus may be modified to accept a gas from a finite source, as illustrated in FIG. 3. The base 15 of the apparatus rests on top of a secondary base 50. The volume of the secondary base is filled with a finite supply of gas. The secondary base 50 comprises a top 51 and sides 52. Within the top 51 is an aperture 53, designed to accommodate the gas exiting the secondary base 50. In addition, the secondary base comprises an adjustable valve 54. The valve 54 is designed to control the flow of air through the aperture of the base to the apparatus 10. The primary base 15 is then placed to rest upon the secondary base 50, with the outlet of the valve extending into the gas inlet 31. Accordingly, in order to accommodate the flow of the gas into the gas inlet 31 at the proper rate, the rate of airflow may be adjusted with the use of the valve.

Regardless of the source of the gas, the apparatus operates to accept gas through the gas inlet 31, and to expel the gas through the output nozzle 23, thereby producing a vortex ring or series of vortex rings. A resilient upper adjustable stop 41 is provided to calibrate the maximum height rise. The calibration of the upper adjustable stop is partly determinative of the size of the vortex ring. As the pocket 21 becomes filled with gas and a unitary bubble of gas is formed, the pressure increases upon the lower side of the lever 24 forcing the lever to move in an upward direction, and forcing the gas to travel to the distal end of the pocket 21 where the gas can then flow through the exit nozzle 23. The surface of the lower side of the lever is smooth. The width of the pocket narrows gradually as the air reaches the nozzle. At such point as the nozzle and pocket merge, the widths are equal, and the surface of this portion of the lever is smooth. The smoothness of the surface contributes to the ability to produce the vortex rings. As the gas enters the nozzle, a minimum of turbulence is created in the gas. When the bubble exits the nozzle, the pocket 21 becomes void of gas, and the weight of the lever causes the lever to move vertically downward and to rest upon the lower adjustable stop 42. Accordingly, the apparatus is designed to operate independently without human intervention, with the limitation of the requirement of a supply of gas.

Figure 4:
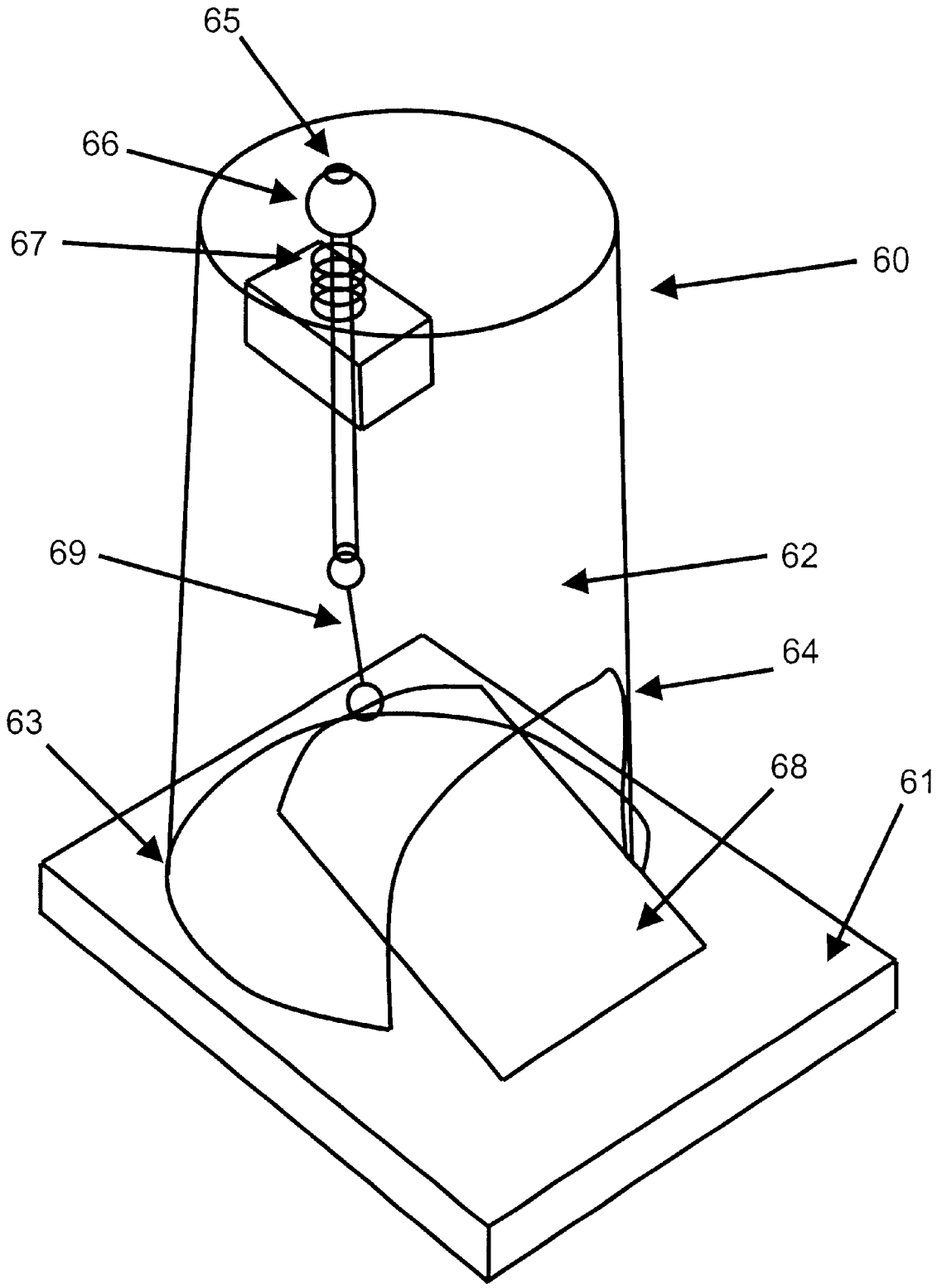
FIG. 4 is perspective view of an alternative apparatus for producing vortex rings.
Figure 5:
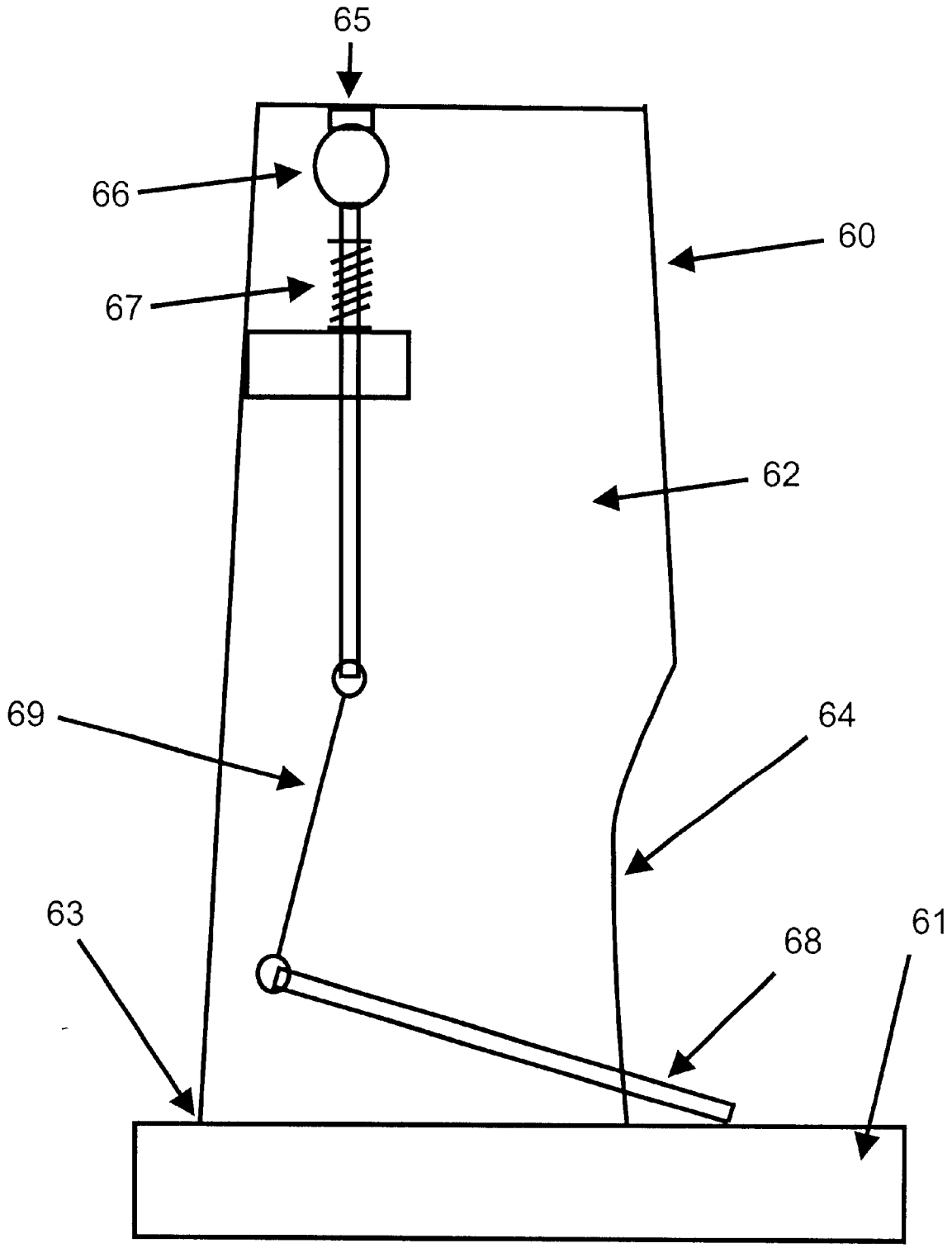
FIG. 5 is a side elevational view of the apparatus of FIG. 4 taken from the right side.

FIGS. 4 and 5 are illustrations of alternative embodiment of the invention. The apparatus 60 shown in these drawing figures is designed to generate vortex rings from a finite source of gas. The apparatus 60 comprises a base 61 and an inverted container 62. The base is comprised of a sufficient mass to maintain the apparatus 60 from floating within a fluid environment, even when the inverted container is filled with a gas. The inverted container 62 is secured to the base 61 at 63, and comprises a large aperture 64 adjacent to the base. At an opposite end of the inverted container 60 is an exit aperture 65 with a circular shape. The internal chamber of the container 60 comprises a stopper 66 for closing the aperture 65. In a rest position, the stopper rests against the aperture 65 and prevents any fluid or gas from exiting the container through this opening. The stopper is biased against the aperture 65 through a spring. The spring 67 is connected to a lever 68 by means of an extended rod. The lever 68 is an actuating device for moving the stopper 66 away from the aperture 65. At such time as the lever 68 is depressed, the tension in the spring 67 increases and the stopper 66 is lowered, allowing a pulse of air to exit the nozzle and enter a fluid environment. Accordingly, the art of generating vortex rings with the apparatus shown in FIGS. 4 and 5, is through a quick depression of the lever 68.

The stopper 66 is a symmetrical ball with smooth surfaces all around. The stopper is centrally positioned within the container 60 and specifically about the aperture 65. The gas within the container is a non-turbulent static gas. However, a quick movement of the lever 68 causes the stopper to be quickly depressed and then raised, causing a single bubble of gas to be released. The bubble of gas that is released has a relatively low amount of turbulence in comparison to ordinary gas bubbles traveling freely upwards through a liquid medium. In addition, the turbulence that does exist in the bubble is symmetrical in relation to the axis that extends straight through the aperture. This turbulence in combination with the symmetry of the stopper 66 in relation to the aperture 65 creates a vortex ring. The apparatus 60 has the ability to generate vortex rings of a larger size than the apparatus shown in FIGS. 1 and 2. However, the apparatus 60 cannot automatically generate a series of vortex rings, as can the apparatus of FIGS. 1 and 2. Accordingly, the apparatus 60 requires manual operation of a lever 68 to generate vortex rings.

Operation of the apparatus 60 to FIGS. 4 and 5 requires minimal skill on the part of the artisan. The user must simply activate the lever 68 in a downward direction, i.e. depress the lever, and quickly release the pressure on the lever 68. The depression of the lever actuates the stopper, temporarily opening the nozzle and releasing a pulse of gas into the fluid. When the user releases the lever 68, the stopper 66 automatically closes the aperture 65 by means of the spring 67. The action involved requires only that the user to learn how to quickly depress and activate the lever 68. The large aperture 64 is large enough so that the lever 68 can be operated by the user's hand or foot. In addition, there are several variations to the vortex rings. Through experimentation, the user can create various vortex rings through different acts and intervals of depressing the lever 68. Accordingly, the apparatus of FIGS. 4 and 5 illustrate an alternative yet simple mechanical apparatus for generating vortex rings in a fluid environment.

Advantages Over the Prior Art

The apparatus disclosed herein mitigates the complexities of both mechanical apparatus and human intervention. There are no valve members associated with the preferred embodiment of the invention. Rather, the preferred embodiment as shown in FIGS. 1 and 2 is a mechanical apparatus wherein the lever is raised and lowered based upon the buoyancy of the gas entering the pocket in relation to the weight of the lever. At such time as the buoyancy of the gas exceeds the weight of the lever, the lever tilts upwards and gas exits the pocket 21 and travels along the surface 24 to the exit nozzle. Upon release of the gas through the nozzle, the lever returns to the position shown in FIG. 2, and gas again begins to enter the pocket. There is no human intervention associated with this embodiment. Once the adjustable stops 41 and 42 are calibrated to properly control the starting and ending height of the lever, the apparatus will continue to generate vortex rings as long as the gaseous supply is provided. The apparatus does not require the gas to be a pressurized gas. Rather, the only restriction on the gas is that the buoyancy of the gas in the pocket on the underside of the lever exceeds the weight of the lever before the pocket has reached maximum capacity of gas. Accordingly, the apparatus shown in FIGS. 1, 2 and 3 mitigates any human intervention following the calibration of the adjustable stops.

In addition to the reduction of human error and or intervention, the apparatus of the preferred embodiment does not require any complex mechanical systems for the generation of vortex rings. As shown in the prior art, apparatus for generating vortex rings generally comprise an plurality of membrane, resilient members, complex valve mechanisms, and/or turbulent fluid. However, the apparatus disclosed and claimed herein comprises an upper adjustable stop in combination with a lower adjustable stop which function to limit the vertical height rise of the lever. The adjustable stops may be calibrated for different fluid environments. In addition, the gas inlet may be adjusted to receive gas from a finite or infinite source. The apparatus of the preferred embodiment has a single gas inlet nozzle and longitudinal nozzle, wherein the longitudinal nozzle may be modified for receiving gas from a finite source or from an infinite source. Accordingly, the apparatus disclosed herein mitigates error and need for replacement of mechanically resilient members.

In a preferred embodiment, the apparatus is immersed in a tank of water, and the gas is a finite amount of air from an enclosed container or an infinite amount of air supplied from an air pump such as a standard aquarium aeration pump. However, the apparatus may accommodate alternative gas elements, or an alternative fluid environment, with the limitation of the buoyancy of the gas entering the pocket exceeding the weight of the lever when a sufficient amount of gas has entered the pocket and formed a unitary bubble of gas.

Alternative Embodiments

It will be appreciated that, although specific embodiments of the invention have been described herein for purposes of illustration, various modifications may be made without departing from the spirit and scope of the invention. In particular, the apparatus may be adapted for functioning with a finite source of gas or from an infinite source. gas. Regardless of the source, the apparatus are simple mechanical apparatus designed to produce vortex rings with minimal human intervention and minimal components that may be subject to failure over an extended period of time. Accordingly, the scope of protection of this invention is limited only by the following claims and their equivalents.

I claim:

1. An apparatus for forming a vortex ring of gas in a fluid medium, comprising:

a base to rest on a planar surface, a lever comprising an upper surface and a lower surface, wherein said lower surface comprises a pocket adapted to receive a bubble of gas;

an inlet nozzle adapted to deliver gas to said pocket;

an exit nozzle located on a distal portion of said lever to release said pas into the liquid medium; and a pair of stops to define vertical displacement limits of said lever.

2. The apparatus of claim 1, wherein said exit nozzle comprises an interior surface with a smooth context.

3. The apparatus of claim 2, wherein said interior surface of said nozzle is curved.

4. The apparatus of claim 3, wherein said lower surface of'said lever adjacent to said exit nozzle slopes upwardly toward said nozzle to provide a smooth surface for displacement of said gas from said pocket to said nozzle.

5. The apparatus of claim 1, further comprising a gas inlet within said base to receive gas from an external source.

6. The apparatus of claim 5, wherein said inlet nozzle extends from said gas inlet into said pocket.

7. The apparatus of claim 2, wherein said pocket extends from a proximal end of said lever adjacent to said inlet nozzle to said exit nozzle.

8. The apparatus of claim 3, wherein said lever is adapted to rise and fall based upon the buoyancy of said gas within said pocket.

9. The apparatus of claim 8, wherein said pocket relcases said gas to said nozzle and forms a vortex ring upon exit from said nozzle.

10. The apparatus of claim 5, wherein said external gas source is an air pump.

11. The apparatus of claim 5, wherein said external gas source is a pocket of gas resting within a container in said fluid medium.

12. The apparatus of claim 11, further comprising an aperture in a top surface of said container to expel said gas into said gas inlet of said base.

13. The apparatus of claim 12, further comprising an adjustable valve to calibrate gas flow from said container.

14. The apparatus of claim 13, wherein adjustment of said valve is determinative of a quantity of vortex rings generated.

15. The apparatus of claim 13, wherein adjustment of said valve is determinative of rate of generation of said vortex rings.

16. The apparatus of claim 1, wherein said upper surface of said lever rests upon a lower surface of an upper adjustable stop during the release of said gas from said pocket to said nozzle.

17. The apparatus of claim 16, wherein the weight of said lever pulls said lever in a vertically downward direction toward a lower adjustable stop following the exit of gas from said nozzle.

18. The apparatus of claim 17, wherein said upper adjustable stop is resilient.

19. The apparatus of claim 1, wherein said fluid is water.

20. The apparatus of claim 1, wherein said gas is air.

* * * * *